US006508384B1

(12) United States Patent
Tien et al.

(10) Patent No.: US 6,508,384 B1
(45) Date of Patent: Jan. 21, 2003

(54) PAINT BALL DELIVERY HOPPER WITH MANUAL DISPENSING VALVE

(76) Inventors: Andrew Tien, 14676 Summerbreeze Cir., Chino Hills, CA (US) 91706; Jarvis D. Tien, 918 W. Beacon St., Alhambra, CA (US) 91801

( * ) Notice: Subject to any disclaimer, the term of this patent is extended or adjusted under 35 U.S.C. 154(b) by 0 days.

(21) Appl. No.: 10/186,012

(22) Filed: Jun. 27, 2002

(51) Int. Cl.[7] ..... B65G 59/00

(52) U.S. Cl. ..... 221/289; 124/50

(58) Field of Search ..... 221/185, 289; 124/49, 50

(56) References Cited

U.S. PATENT DOCUMENTS 6,055,975 A * 5/2000 Gallagher et al. ..... 124/50

* cited by examiner

*Primary Examiner*—Kenneth W. Noland
(74) *Attorney, Agent, or Firm*—Gene Scott-Patent Law & Venture Group

(57) ABSTRACT

A paintball dispensing hopper has an insulating sidewall enclosing a paintball storage space with an open top. A hinged top cover moves between an open position providing access to the open top of the container for filling the storage space with paintballs, and a closed position sealing the open top of the container. All interior surfaces of the sidewall are curved in a manner for directing the paintballs toward a lower frontal dispensing tube. A dispensing valve is engaged with the dispensing tube for dispensing the paintballs by either rotation or linear motion.

12 Claims, 2 Drawing Sheets

PAINT BALL DELIVERY HOPPER WITH MANUAL DISPENSING VALVE

BACKGROUND OF THE INVENTION

1. Field of the Invention

This invention relates generally to dispensing containers and more particularly to a paintball hopper with novel dispensing valve.

2. Description of Related Art

The following art defines the present state of this field:

Containers are used to hold a wide range of items from foodstuffs to mechanical hardware, etc. Containers are constructed of a wide range of materials including plastic, glass, metal and wood. Paintballs are small, round objects that are fragile so as to be handled with care lest they break open releasing the paint fluid stored within. Today, these balls are handle manually and therefore create a mess when stepped on. A storage container for paintballs must have a release mechanism that does not unduly stress the paintball but provides ball release with ease and in an amount necessary to fill the receiver of a paintball gun. The paintballs should be stored in a temperature controlled environment. A container of such capability is not known in the art at this time.

The prior art teaches a broad range of containers but does not teach a hopper for storage of paintballs for use in paintball guns. The present invention fuilfills these needs and provides further related advantages as described in the following summary.

SUMMARY OF THE INVENTION

The present invention teaches certain benefits in construction and use which give rise to the objectives described below.

A paintball dispensing hopper has an insulating sidewall enclosing a paintball storage space with an open top. A hinged top cover or other equivalent structure moves between an open position providing access to the open top of the container for filling the storage space with paintballs, and a closed position sealing the open top of the container. All interior surfaces of the sidewall are curved in a manner for directing the paintballs toward a lower frontal dispensing tube. A dispensing valve is engaged with the dispensing tube for dispensing the paintballs by either rotation or linear motion.

A primary objective of the present invention is to provide an apparatus and method of use of such apparatus that provides advantages not taught by the prior art.

Another objective is to provide such an invention capable of storing paintballs at a cool temperature.

A further objective is to provide such an invention capable of dispensing a desired number of paintballs.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
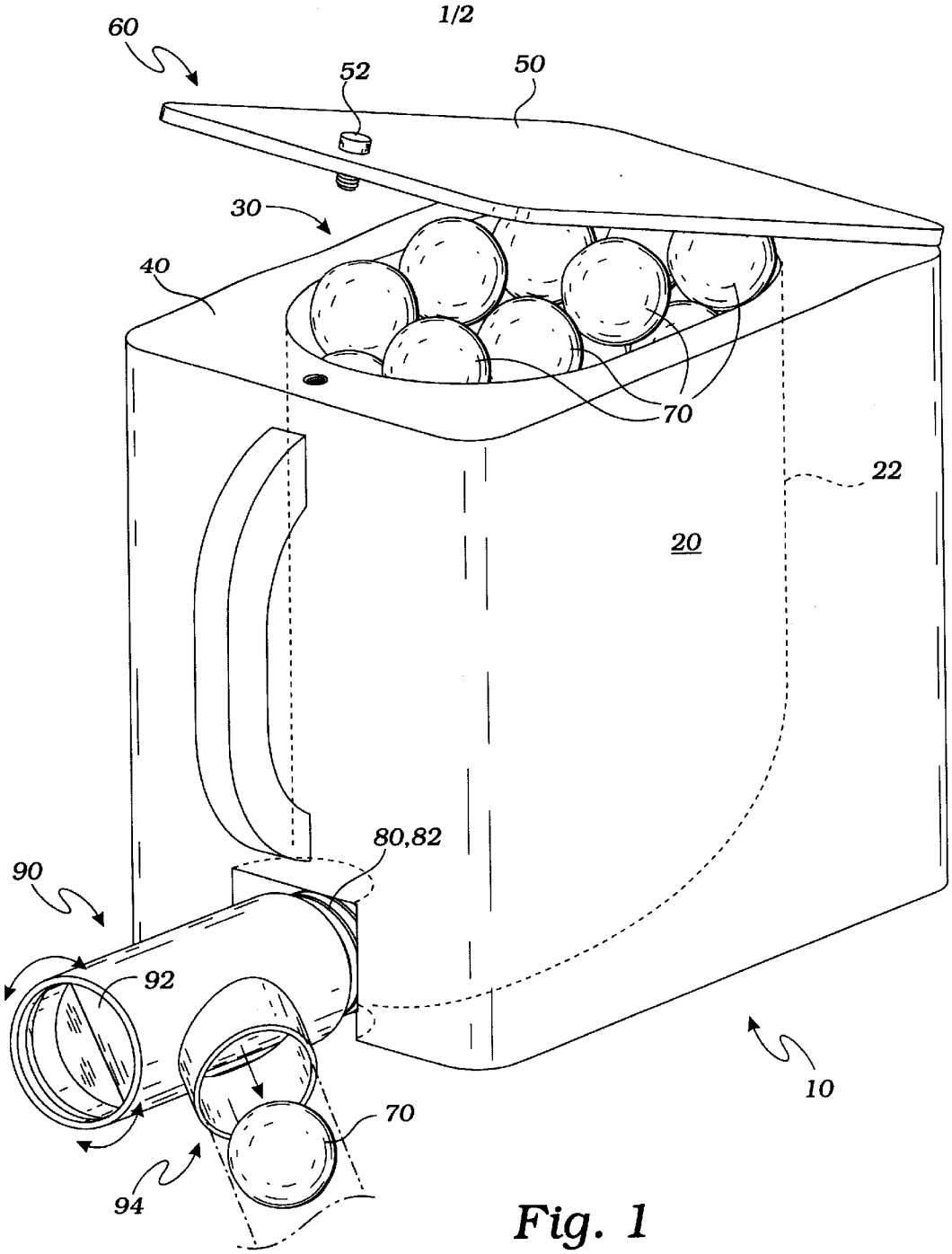
FIG. 1 is a perspective view of the preferred embodiment of the invention.
Figure 2:
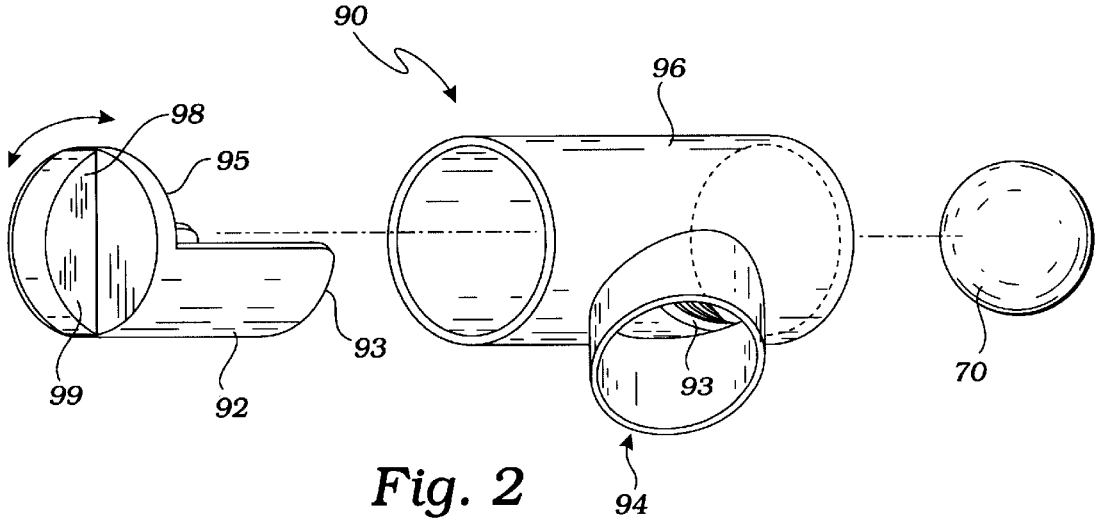
FIG. 2 is an exploded view of a dispensing valve thereof for rotational dispensing.

The above described drawing figures illustrate the invention in at least one of its preferred embodiments, which is further defined in detail in the following description.

The present invention is a paintball dispensing hopper apparatus having a container 10 with a thermally insulating sidewall 20 enclosing a paintball storage space 30. The container 10 has an open top 40 with a cover 50, such as the hinged cover shown in FIG. 1, adapted for moving between an open position 60 providing access to the open top 40 of the container 10 for filling the container 10 with paintballs 70, and a closed position (not shown) sealing the open top 40 of the container 10. An interior surface 22 of the sidewall 20 is curved in a manner for directing the paintballs 70 toward a frontal dispensing tube 80. Preferably, a bottom surface 23 of the container 10 is sloped at a minimum of 5 degrees for also urging the paintballs 70 toward the dispensing tube 80. A dispensing valve 90 engages the dispensing tube 80, preferably by threads 82 and 92, so as to provide a simple means for dispensing the paintballs.

The hinged top cover 50 provides a means for latching 52 the cover 50, when the cover 50 is in the closed position 60', to the container 10. Such a latching means 52 may be the threaded fastener shown in FIG. 1 or any equivalent.

The dispensing valve 90 is preferably adapted for releasing the paintballs 70 when an inner cylinder 92 of the dispensing valve 90 is rotated so as to uncover a dispensing aperture 94. In this embodiment, this occurs when the inner cylinder 92 has an extending portion 93 and a shortened portion 95 such that with the extended portion 93 positioned over the dispensing aperture 94, a paintball 70 lodged in the inner cylinder 92 cannot move to the dispensing aperture 94, but when the inner cylinder 92 is rotated so that the extending portion 93 uncovers the dispensing aperture 94, the paintball 70 is able to exit. This structure and action is shown in FIG. 1. Preferably, the dispensing nozzle is of such size and length as to prevent paint balls from overfilling the typical tube magazine into which the balls are dispensed.

Figure 3:
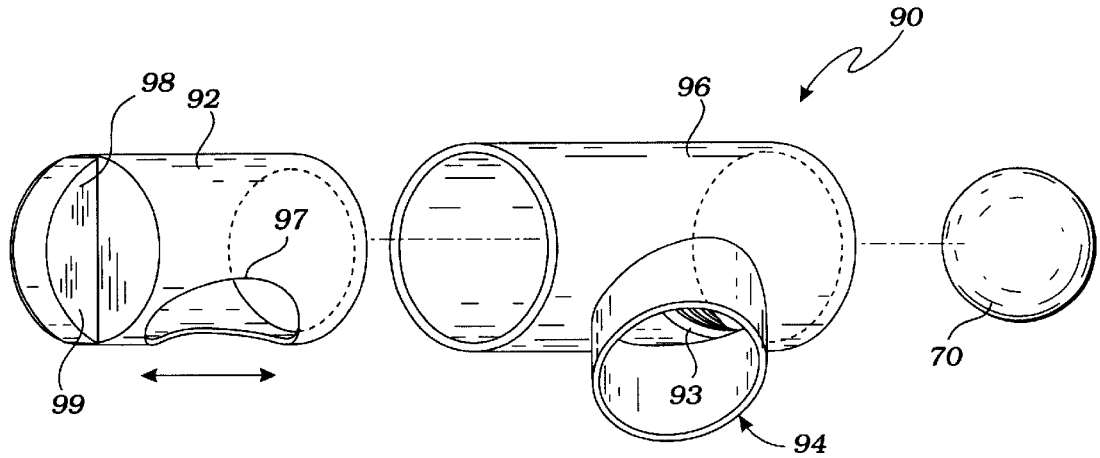
FIG. 3 is an exploded view of a dispensing valve thereof for push-pull dispensing.

The dispensing valve 90, alternately, may be adapted for releasing the paintballs 70 when the inner cylinder 92 of the dispensing valve 90 is moved axially. This occurs when an opening 96 in the inner cylinder 92 is moved so as to coincide with the dispensing aperture 94. This structure and action is shown in FIG. 3.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A paintball dispensing hopper apparatus comprising: a container having a sidewall enclosing a paintball storage space with an open top; a cover means is adapted for moving between an open position providing access to the open top of the container, and a closed and latched position sealing the open top of the container; an interior surface of the sidewall is curved in a manner for urging plural paintballs, stored in the paintball storage space, toward a frontal dispensing tube; a dispensing valve is engaged with the dispensing tube, the dispensing valve providing means for dispensing the paintballs by one of manual rotation and manual translation.

2. The apparatus of claim 1 wherein the container and the cover means are made of thermally insulating material.

3. The apparatus of claim 1 wherein the dispensing valve is adapted for releasing the paintballs when an inner cylinder of the dispensing valve is rotated, the inner cylinder providing an extended portion positionable for covering a dispensing aperture.

4. The apparatus of claim 1 wherein the dispensing valve is adapted for releasing the paintballs when an inner cylinder of the dispensing valve is moved axially for positioning an inner cylinder aperture and the dispensing aperture in alignment.

5. An apparatus comprising in combination: a paintball storage and dispensing container having a sidewall enclosing a paintball storage space with an open top; a cover means is adapted for moving between an open position providing access to the open top of the container, and a closed and latched position sealing the open top of the container; an interior surface of the sidewall is curved in a manner for urging plural paintballs, stored in the paintball storage space, toward a frontal dispensing tube; a dispensing valve is engaged with the dispensing tube, the dispensing valve providing means for dispensing the paintballs by one of manual rotation and manual translation; and a plurality of paintballs within the storage space of the container, the paintballs enabled by size and conformation for moving through the dispensing valve.

6. The apparatus of claim 5 wherein the container and the cover means are made of thermally insulating material.

7. The apparatus of claim 5 wherein the dispensing valve is adapted for releasing the paintballs when an inner cylinder of the dispensing valve is rotated, the inner cylinder providing an extended portion positionable for covering a dispensing aperture.

8. The apparatus of claim 5 wherein the dispensing valve is adapted for releasing the paintballs when an inner cylinder of the dispensing valve is moved axially for positioning an inner cylinder aperture and the dispensing aperture in alignment.

9. A paintball dispensing hopper apparatus comprising: a container having a sidewall enclosing a paintball storage space with an open top; a cover means is adapted for moving between an open position providing access to the open top of the container, and a closed and latched position sealing the open top of the container; an interior surface of the sidewall is curved in a manner for urging plural paintballs, stored in the paintball storage space, toward a frontal dispensing tube; a bottom surface of the container is sloped at, at least 5 degrees toward the dispensing tube, a dispensing valve is engaged with the dispensing tube, the dispensing valve providing means for dispensing the paintballs by one of manual rotation and manual translation.

10. The apparatus of claim 9 wherein the container and the cover means are made of thermally insulating material.

11. The apparatus of claim 9 wherein the dispensing valve is adapted for releasing the paintballs when an inner cylinder of the dispensing valve is rotated, the inner cylinder providing an extended portion positionable for covering a dispensing aperture.

12. The apparatus of claim 9 wherein the dispensing valve is adapted for releasing the paintballs when an inner cylinder of the dispensing valve is moved axially for positioning an inner cylinder aperture and the dispensing aperture in alignment.

* * * * *